US006505368B1

(12) United States Patent
Ellis et al.

(10) Patent No.: US 6,505,368 B1
(45) Date of Patent: Jan. 14, 2003

(54) MATTRESS ASSEMBLY

(75) Inventors: Craig D. Ellis, Charleston, SC (US); Leigh Marie Moses, Summerville, SC (US); Kenith W. Chambers, Charleston, SC (US); Stephen E. Glover, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/607,474

(22) Filed: Jun. 30, 2000

Related U.S. Application Data

(60) Provisional application No. 60/142,364, filed on Jul. 6, 1999.

(51) Int. Cl.[7] ..... A47C 27/08
(52) U.S. Cl. ..... 5/713; 5/710; 5/737
(58) Field of Search ..... 5/699, 713, 710, 5/737–740

(56) References Cited

U.S. PATENT DOCUMENTS

| | | | | |
|---|---|---|---|---|
| 1,730,752 A | | 10/1929 | Withers | 5/348 |
| 2,604,641 A | | 7/1952 | Reed | 5/349 |
| 3,772,717 A | | 11/1973 | Yuen et al. | 5/349 |
| 3,978,530 A | | 9/1976 | Amarantos | 5/349 |
| 4,042,988 A | | 8/1977 | Holliday | 5/349 |
| 4,525,885 A | | 7/1985 | Hunt et al. | 5/453 |
| 4,541,135 A | | 9/1985 | Karpov | 5/455 |
| 4,644,597 A | | 2/1987 | Walker | 5/449 |
| 4,788,729 A | | 12/1988 | Walker | 5/449 |
| 4,803,744 A | | 2/1989 | Peck et al. | 5/453 |
| 4,944,060 A | * | 7/1990 | Peery et al. | 5/737 X |
| 5,022,110 A | | 6/1991 | Stroh | 5/455 |
| 5,067,189 A | | 11/1991 | Weedling et al. | 5/453 |
| 5,101,527 A | * | 4/1992 | Wadsworth, III et al. | 5/737 X |
| 5,323,501 A | * | 6/1994 | Kuhangel | 5/737 X |
| 5,367,728 A | | 11/1994 | Chang | 5/453 |
| 5,428,852 A | * | 7/1995 | Tenuta et al. | 5/738 X |
| 5,483,709 A | | 1/1996 | Foster et al. | 5/453 |
| 5,491,854 A | * | 2/1996 | Music | 5/737 X |
| 5,539,942 A | | 7/1996 | Melou | 5/453 |
| 5,561,873 A | | 10/1996 | Weedling | 5/711 |
| 5,564,142 A | | 10/1996 | Liu | 5/689 |
| 5,611,096 A | | 3/1997 | Bartlett et al. | 5/617 |
| 5,634,225 A | | 6/1997 | Miller, Sr. et al. | 5/716 |
| 5,655,239 A | | 8/1997 | Caparon et al. | 5/713 |
| 5,666,681 A | * | 9/1997 | Meyer et al. | 5/710 X |
| 5,701,622 A | | 12/1997 | Biggie et al. | 5/713 |
| 5,729,853 A | | 3/1998 | Thompson | 5/713 |
| 5,745,937 A | * | 5/1998 | Weismiller et al. | 5/710 X |

(List continued on next page.)

FOREIGN PATENT DOCUMENTS

| | | |
|---|---|---|
| AT | 401 611 B | 10/1996 |
| DE | 295 21 505 | 1/1998 |
| DE | 297 17 204 | 12/1998 |
| EP | 0 579 381 A2 | 1/1994 |
| GB | 2 092 439 | 8/1982 |
| GB | 2 267 217 | 12/1993 |
| WO | WO 86/03106 | 6/1986 |
| WO | WO 92/02200 | 2/1992 |

*Primary Examiner*—Suzanne Dino Barrett
(74) *Attorney, Agent, or Firm*—Bose McKinney & Evans LLP

(57) ABSTRACT

A mattress assembly for supporting a patient includes a body support portion having a head end, a foot end, and a knee support portion. The body support portion has a first air zone extending from the head end to the knee support portion and a second air zone extending from the knee support portion to the foot end. The mattress assembly also includes a control module configured to supply air to the first and second air zones to maintain the first air zone at a substantially constant first pressure and to maintain the second air zone at a substantially constant second pressure. The second pressure is less than the first pressure to provide reduced pressure on a patient's calves and feet located on the second air zone.

26 Claims, 7 Drawing Sheets

U.S. PATENT DOCUMENTS 5,745,941 A * 5/1998 Miller, Sr. ..... 5/710
5,755,000 A 5/1998 Thompson ..... 5/713
5,787,531 A * 8/1998 Pepe ..... 5/710
5,794,288 A 8/1998 Soltani et al. ..... 5/713
5,815,864 A * 10/1998 Sloop ..... 5/710 X
5,815,865 A * 10/1998 Washburn et al. ..... 5/713
5,926,883 A * 7/1999 Rechin et al. ..... 5/710 X
5,934,280 A * 8/1999 Viard et al. ..... 5/710 X
5,991,949 A 11/1999 Miller, Sr. et al. ..... 5/710
6,014,784 A * 1/2000 Taylor et al. ..... 5/710 X
6,016,582 A * 1/2000 Larson ..... 5/710 X
6,047,423 A * 4/2000 Larson ..... 5/710 X
6,061,855 A * 5/2000 Flick ..... 5/710 X
6,085,372 A * 7/2000 James et al. ..... 5/713
6,112,350 A * 9/2000 Larson ..... 5/710
6,151,739 A * 11/2000 Meyer et al. ..... 5/713 X
6,178,578 B1 * 1/2001 Soltani et al. ..... 5/713
6,202,239 B1 * 3/2001 Ward et al. ..... 5/740 X
6,121,718 A1 * 4/2001 Stolpmann et al. ..... 5/713
6,223,369 B1 * 5/2001 Maier et al. ..... 5/739 X
6,240,584 B1 * 6/2001 Perez et al. ..... 5/710 X
6,282,735 B1 * 9/2001 Stolpmann et al. ..... 5/740 X

* cited by examiner

MATTRESS ASSEMBLY

This application claims the benefit of U.S. provisional application Ser. No. 60/142,364 filed on Jul. 6, 1999, which is expressly incorporated by reference.

BACKGROUND AND SUMMARY OF THE INVENTION

The present invention relates to a mattress assembly for use on a bed. More particularly, the present invention relates to a therapy surface which provides pressure reduction for patients at risk of development of pressure ulcers.

The mattress assembly of the present invention provides a support surface that automatically adjusts to the weight distribution of the patient. A foot end section of the mattress provides a significantly lower pressure than a body section of the mattress to address pressure reduction requirements adjacent the heels of a patient.

The mattress assembly of the present invention includes a two-zoned air mattress configured to reduce the likelihood of development of pressure ulcers for low to moderate risk patients. A first zone of the mattress extends from a head of the bed to a calf section. A second zone extends from the calf section to a foot of the bed. The bladder located under the patient's heels has an extremely low pressure setting and the bladder under the body portion of the patient has a higher range pressure setting. The height of the mattress when the bladder is fully inflated is about 7 inches. The combination of bladders of the mattress are designed to support a 300 pound patient.

A foam topper is located above the air bladders to increase comfort of the mattress assembly. The mattress assembly has perimeter foam bolsters extending along opposite sides to provide extra support along the edges of the mattress. A foam base is provided under the air bladders to reduce the likelihood that a patient will bottom out against a frame of a bed on which the mattress is located.

The top coverlet includes ticking that is made of a urethane coated fabric. The top coverlet is illustratively a fitted sheet design which is held securely in place by an elastic border and two straps that extend under a bottom cover of the mattress. The new coverlet design does not require a zipper for connection of the coverlet to the rest of the mattress assembly. Two magnets on the bottom cover to aid in sheet retention.

The mattress assembly of the present invention is automatically in a pressure reduction mode when a controller is turned on. The present invention provides a normally deflated air bladder on top of the support air bladders. This normally deflated bladder is selectively inflated for CPR mode or for an auto firm mode for transferring a patient into or out of bed or for positioning the patient on to the mattress.

In the illustrated embodiment, a mattress assembly for supporting a patient includes a body support portion having a head end, a foot end, and a knee support portion located between the head end and the foot end under the patient's knees. The body support portion has a first air zone extending from the head end to the knee support portion and a second air zone extending from the knee support portion to the foot end. The mattress assembly also includes a control module coupled to the first and second air zones. The control module is configured to supply air to the first and second air zones to maintain the first air zone at a substantially constant first pressure and to maintain the second air zone at a substantially constant second pressure. The second pressure is less than the first pressure to provide reduced pressure on a patient's calves and feet located on the second air zone.

The illustrated embodiment also includes a normally deflated bladder located above the body support portion. The normally deflated bladder is coupled to the control module for selectively inflating and deflating the normally deflated bladder. Illustratively, the control module is configured to inflate the normally deflated bladder to a third pressure which is greater than the first and second pressures.

Also in the illustrated embodiment, a mattress assembly for supporting a patient includes a mattress core having a top surface, a bottom surface, and an outer peripheral edge extending between the top surface and the bottom surface. The mattress assembly also includes a coverlet formed from a liquid impermeable material. The coverlet includes an upper surface located above the top surface of the mattress core and a side wall extending downwardly from the upper surface. The side wall is configured to extend over the outer peripheral edge of the mattress core and under the bottom surface of the mattress core. The coverlet includes an elastic cord coupled to the side wall to hold the side wall of the under the bottom surface of the mattress core and at least one strap extending under the bottom surface of the mattress core and being coupled between opposite side portions of the side wall of the coverlet.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which.

DETAIL DESCRIPTION OF THE DRAWINGS

Figure 1:
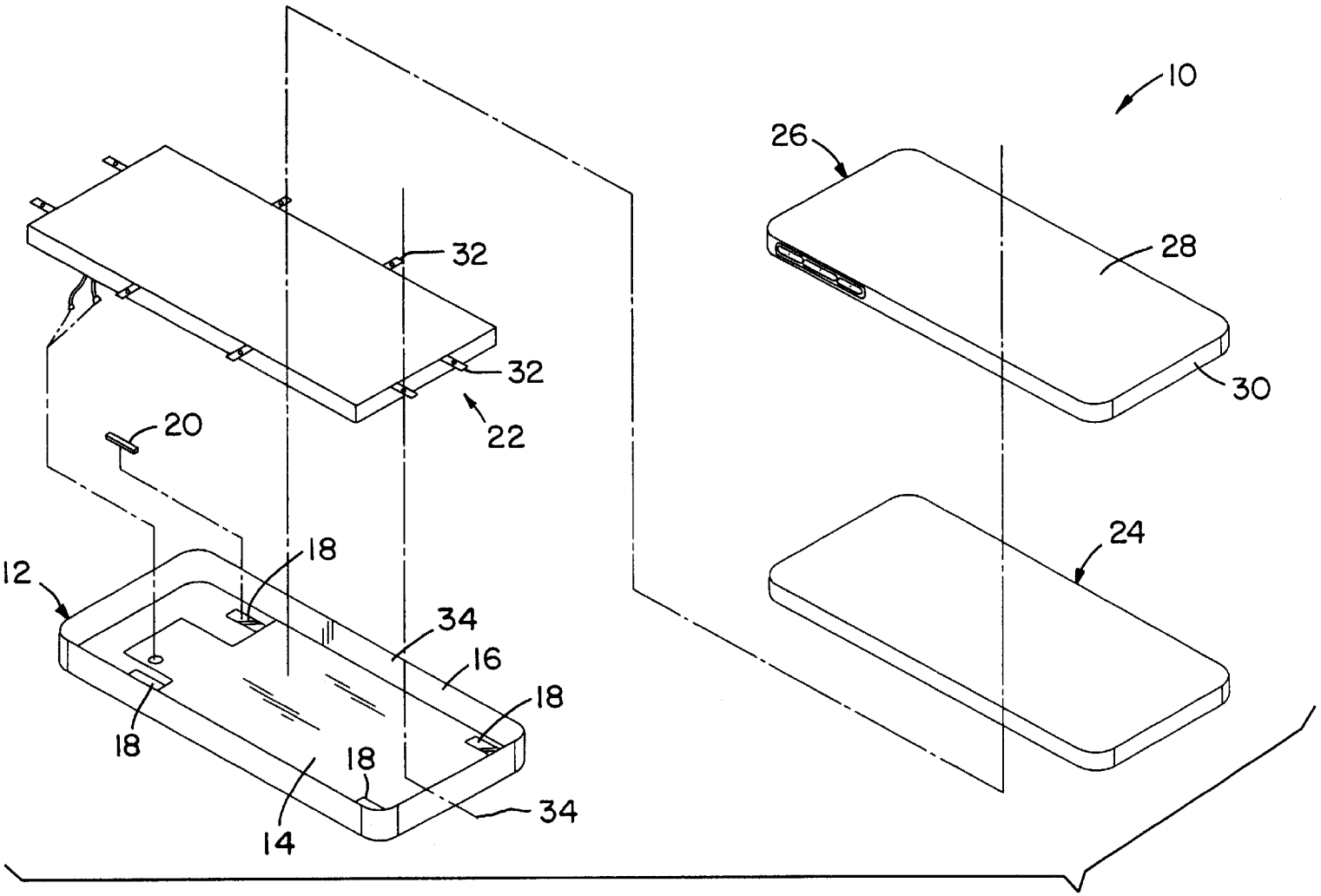
FIG. 1 is an exploded perspective view of the mattress assembly of the present invention.

Referring now to the drawings, FIG. 1 illustrates a mattress assembly 10 of the present invention. The mattress assembly 10 includes a bottom encasement or cover 12 having a bottom surface 14 and a side wall 16. Four pockets 18 are formed on the bottom surface 14 for receiving magnets 20. The magnets 20 help hold the mattress 10 in place on a deck of a bed and provide improved sheet retention.

A support subassembly 22 is discussed in detail below. The support subassembly 22 is located on the bottom surface 14 of the bottom cover 12. A shear force reducing inner liner 24 made from a low friction material is located over the support subassembly 22. A top coverlet 26 includes a top surface 28 for supporting a patient and a sidewall 30 which extends downwardly over the sidewall 16 and under bottom surface 14 of the bottom cover 12 is discussed in detail below. Shear liner 24 permits the top coverlet 26 to slide easily relative to the mattress subassembly 22 to reduce shear forces on the patient. Tabs 32 of the support subassembly 22 are coupled to the side wall 16 of bottom cover 12 by snaps 34 or other suitable fasteners such as ties, Velcro® fasteners, buckles or the like.

Figure 2:
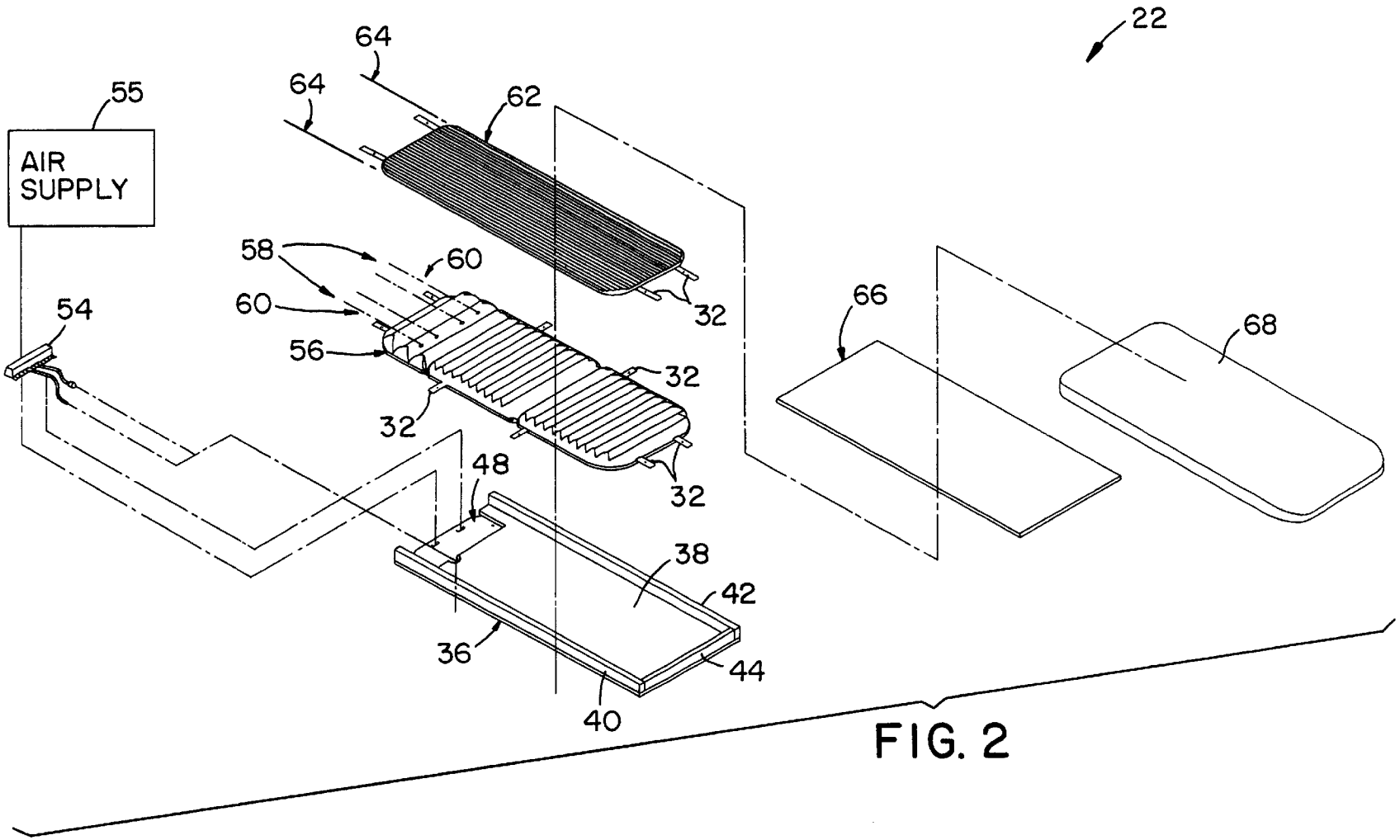
FIG. 2 is an exploded perspective view of a mattress support subassembly of the present invention.
Figure 3:
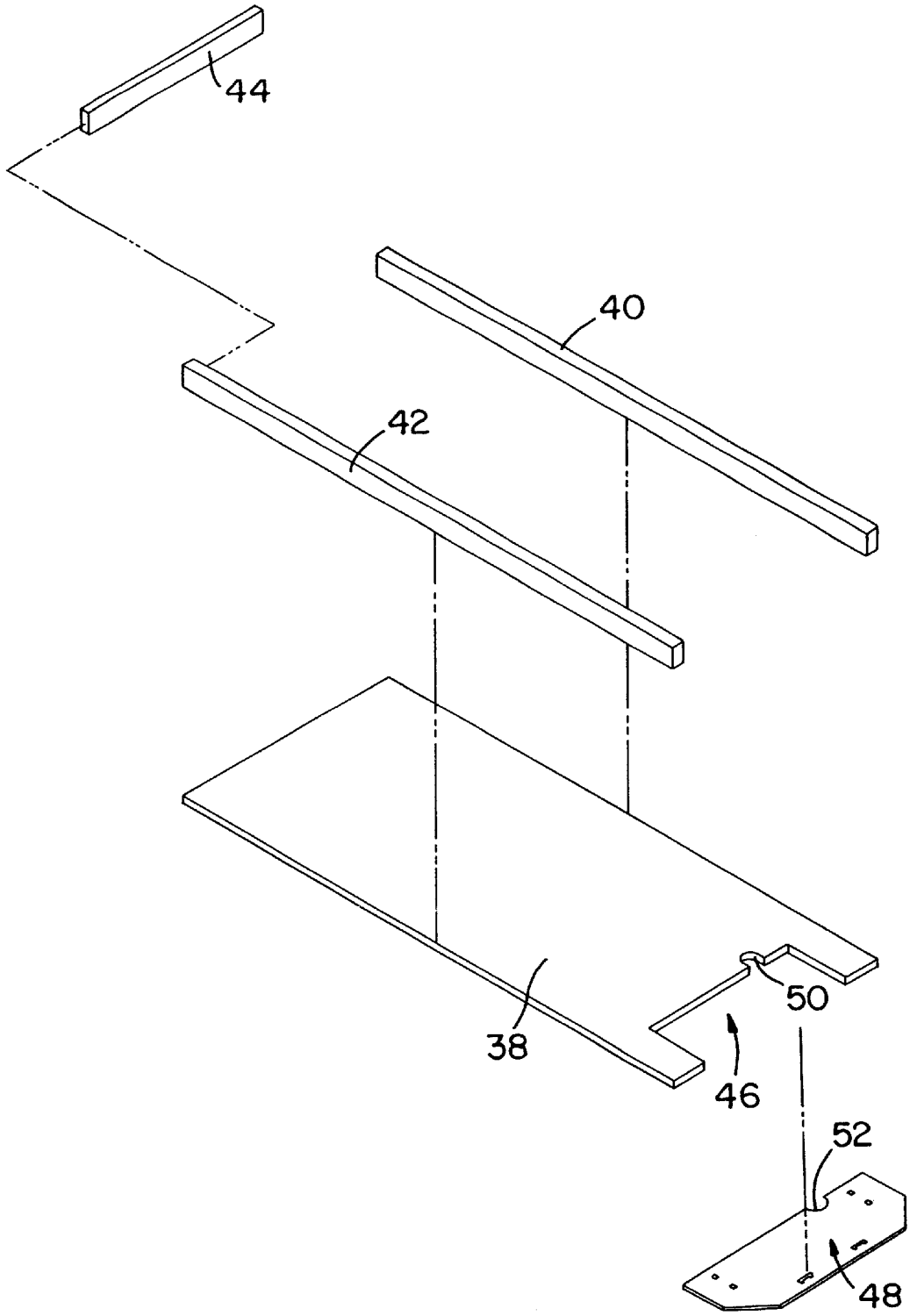
FIG. 3 is an exploded perspective view of a foam base and plate assembly.

The support subassembly 22 is further illustrated in FIG. 2. Support subassembly 22 includes a foam base 36 having a bottom foam surface 38, first and second foam side bolsters 40 and 42, and a foam head bolster 44. Base 36 is best illustrated in FIG. 3. The bolsters 40, 42, and 44 are coupled together and to the bottom surface 38 by a suitable adhesive. Bottom surface 38 includes a recessed portion 46 configured to receive a mounting plate 48. A notched portion 50 formed in bottom surface 38 cooperates with a notched portion 52 in plate 48 to provide an opening to permit air supply lines to be routed into the support subassembly 22.

Figure 7:
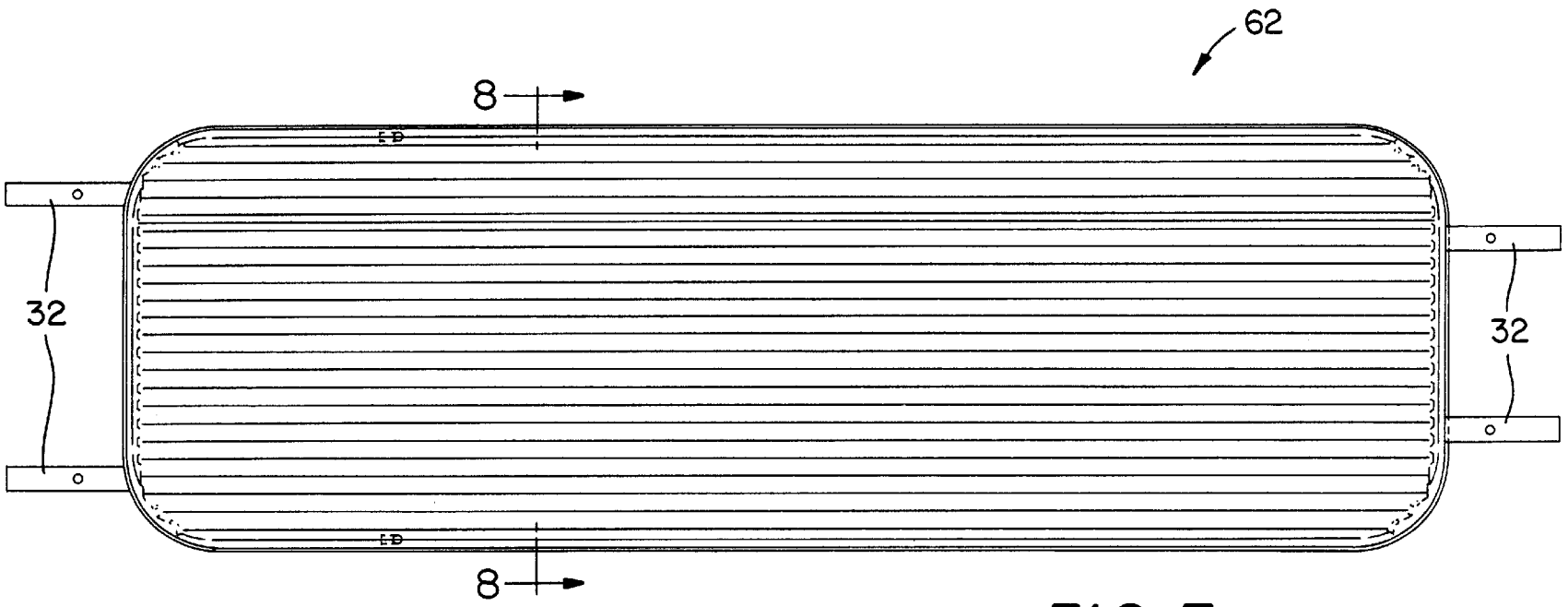
FIGS. 7 and 8 illustrate a normally deflated autofirm bladder.
Figure 8:
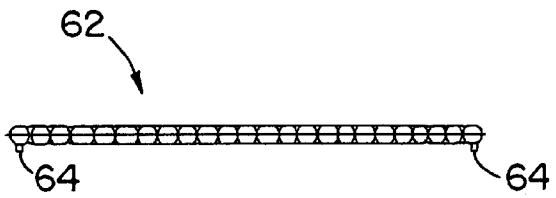

Referring again to FIG. 2, a surface control module 54 is mounted on plate 48. Control module 54 includes sensors and valves to control air flow to various air zones of the support subassembly 22. A body support portion 56 is located over bottom surface 38 of base 36. Air supply hoses 58 and connectors 60 are used to supply air from an air supply 55 through control module 54 to the zones of the body support portion 56 as discussed below. An autofirm bladder 62 is located above body support portion 56. As discussed below, autofirm bladder 62 is normally deflated within the support subassembly 22. Autofirm bladder 62 is inflated during CPR mode or during autofirm mode to assist with transfer or positioning of the patient. Additional details of the autofirm bladder 62 are illustrated in FIGS. 7 and 8. Supply hoses 64 provide air to the autofirm bladder 62 from the control module 54. A foam layer 66 is provided over the autofirm cushion 62. A fire barrier 68 surrounds the mattress subassembly 22.

Figure 4:
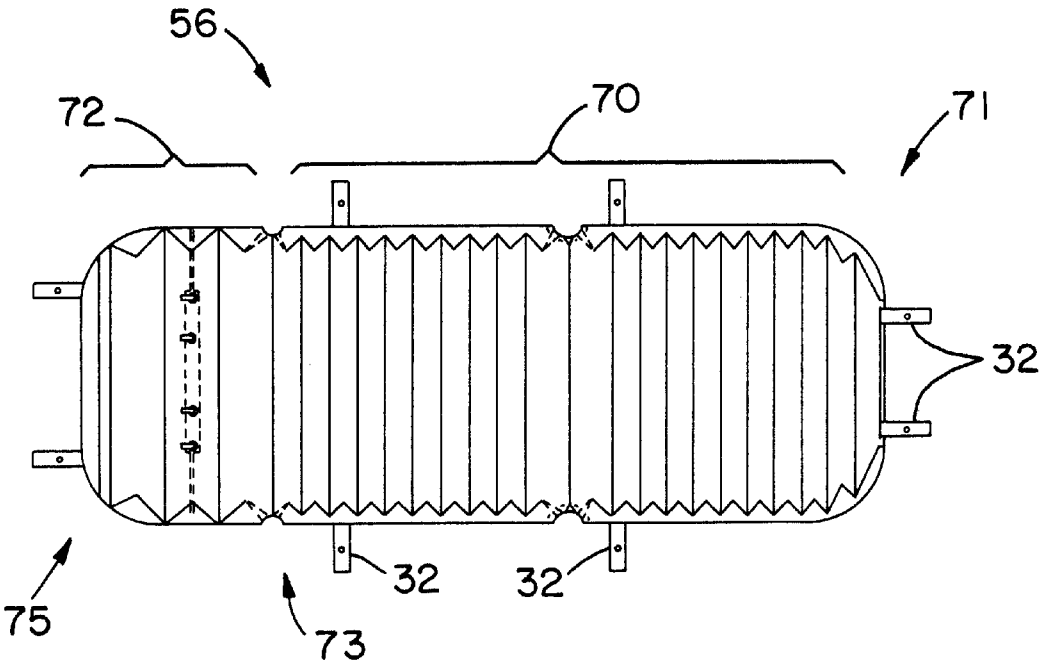
FIGS. 4 and 5 illustrate a body support portion having two separately controlled zones of air bladders.
Figure 5:
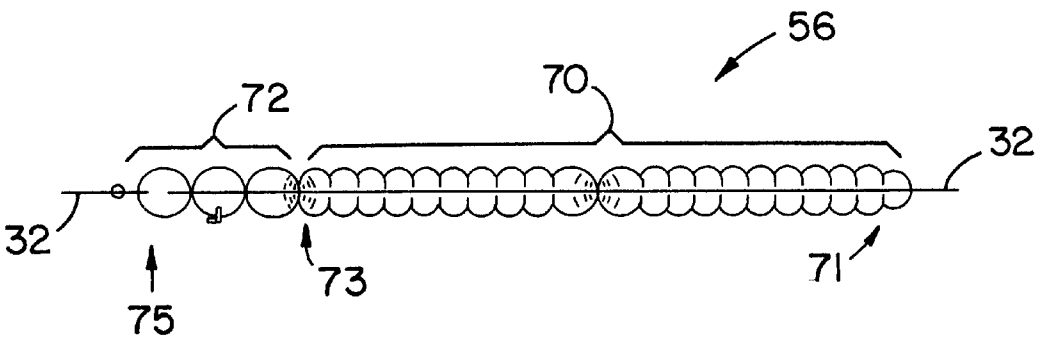
Figure 6:
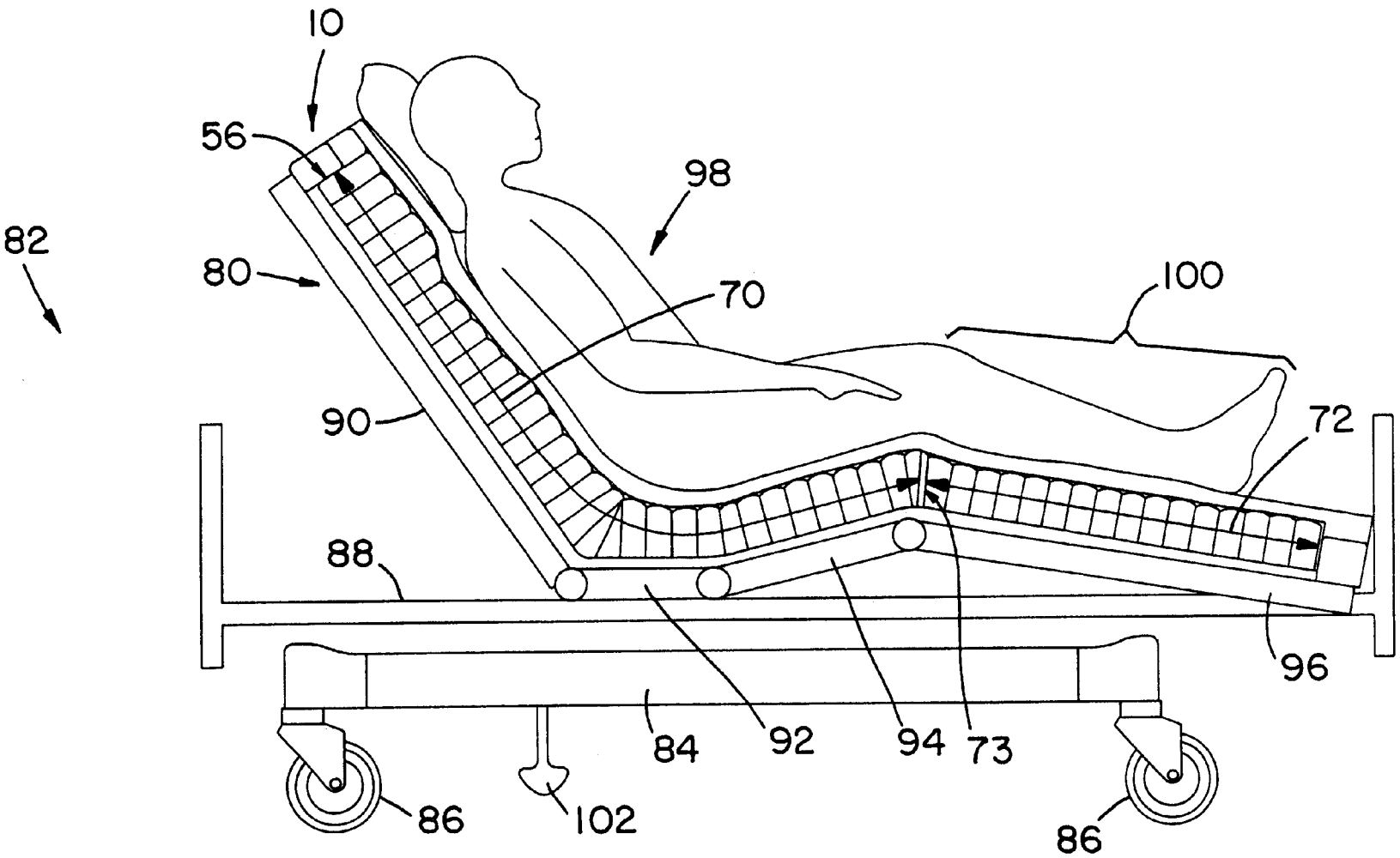
FIG. 6 is a diagrammatical view of the mattress assembly located on a deck of a bed for supporting a patient.

The body support portion 56 includes air bladders having two separately inflatable zones and three chambers as illustrated in FIGS. 4–6. A first zone 70 extends from a head end 71 of the body support portion 56 to a knee support portion 73. A second zone 72 extends from the knee support portion 73 to a foot end 75 of the body support portion 56. These two zones 70, 72 are maintained at a constant pressure, regardless of patient size. Illustratively, foot zone 72 is maintained at a substantially constant pressure of about 0.2 inch of water (0.007 psi). The head zone 70 is maintained at a substantially constant pressure of about 0.5 inch of water (0.018 psi). Both zone bladder pressures are measured with no weight on the support surface. The mattress assembly 10 of the present invention therefore automatically optimizes patient to surface interface pressure distribution. The two-zone design delivers a lower pressure in the lower leg and heel section of the patient located over foot zone 72 , thereby allowing for more comformability and enhanced pressure reduction in zone 72.

FIG. 6 is a diagrammatical view illustrating the mattress assembly 10 located on an articulating deck 80 of a bed 82. Bed 82 illustratively includes a base 84 and casters 86. A base 84 supports a frame 88 in a conventional manner. Frame 88 also supports the articulating deck 80 in a conventional manner. It is understood that any type of known linkages are provided between the base 84 and frame 88 and the frame 88 and deck 80.

Illustratively, deck 80 includes a head deck section 90, a seat deck section 92, a thigh deck section 94, and a foot deck section 96. The mattress assembly is located on the deck 80 to support a patient 98. As illustrated in FIG. 6, knee support portion 73 of body support portion 56 is located adjacent a knee of the patient 98. The calves and feet of the patient 98 illustrated in region 100 are located over second zone 72 of body support portion 56 as shown diagrammatically in FIG. 6. Therefore, very low pressure is maintained on the calves and heels of the patient.

In an autofirm mode, a controller inflates the autofirm bladder 62 to about 25 inches of water (about 0.9 psi) to assist in the transfer of patients on and off of the mattress 10. The autofirm bladder 62 is also inflated to the same pressure in CPR mode. A controller detects movement of a CPR switch on the bed 82, such as when a CPR foot pedal 102 on the bed 82 is pressed to move the deck 80 and frame 88 of bed 82 to a CPR position. The control module 54 then automatically activates an air supply device to inflate the autofirm bladder 62 to the high pressure setting to provide support for performing CPR on the patient 98.

Figure 9:
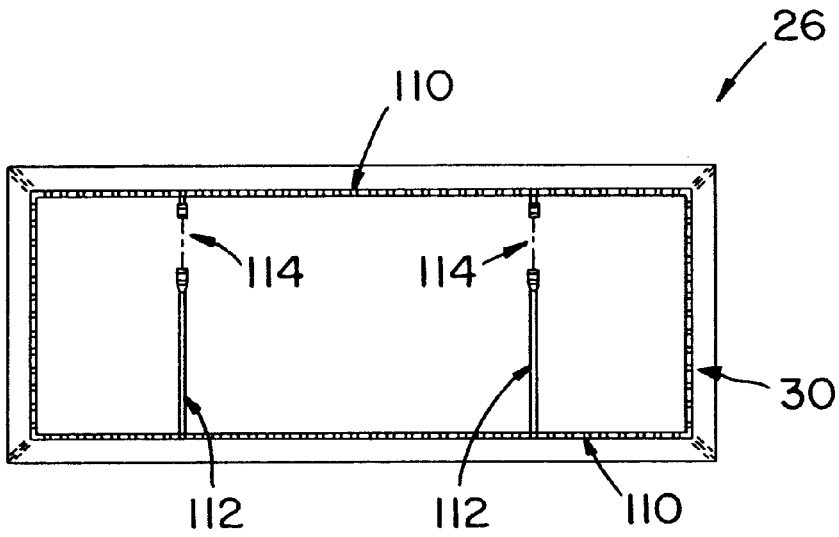
FIGS. 9 and 10 illustrate details of a top coverlet.
Figure 10:
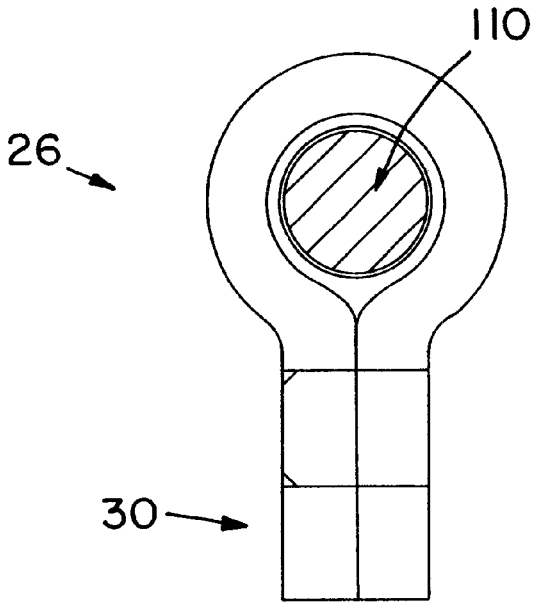

FIGS. 9 and 10 illustrate additional details of the top coverlet 26. The top coverlet 26 has a flat layout before the seams are welded. Coverlet 26 is illustrated fluid impermeable. As shown in FIG. 9, the top coverlet 26 fits like a fitted sheet over the rest of the mattress assembly 10. An elastic cord 110 is coupled to a bottom end of side wall 30 as best shown in FIG. 10. A portion of the side wall 30 extends under the bottom cover 12 as shown best by FIG. 9. Therefore, the elastic cord 110 holds an end portion of the side wall 30 under the bottom cover 12. Straps 112 extend transversely under the bottom cover 12 to secure the coverlet 26 to the bottom cover 12. Illustratively, buckles 114 are used to secure straps 82 together. Ties, snap, Velcro® fasteners, or the like may also be used to secure the straps 82 together. Therefore, the coverlet 26 is coupled to the bottom cover 12 without the use of a zipper.

Although the invention has been described in detail with reference to certain illustrated embodiments, variations and modifications exist within the scope and spirit of the present invention as defined in the following claims.

What is claimed:

1. A mattress assembly for supporting a patient, the mattress assembly comprising;

a body support portion having a head end, a foot end, and a knee support portion located between the head end and the foot end under the patient's knees;

a bottom cover portion located below the body support portion; and a top coverlet located above the body support portion, the top coverlet being formed from a liquid impermeable material, the body support portion having a first air zone extending from the head end to the knee support portion and a second air zone extending from the knee support portion to the foot end, and a control module coupled to the first and second air zones, the control module being configured to supply air to the first and second air zones to maintain the first air zone at a substantially constant first pressure and to maintain the second air zone at a substantially constant second pressure, the second pressure being less than the first pressure to provide reduced pressure on a patient's calves and feet located on the second air zone, the top coverlet including a top surface and a side wall extending downwardly from the top surface, the side wall being configured to extend over an outer peripheral edge of the body support portion and under a bottom surface of the body support portion, the top coverlet including an elastic cord coupled to the side wall to hold the side wall of the coverlet under the bottom surface of the body support portion.

2. The mattress assembly of claim 1, wherein the first air zone pressure is about 0.018 psi and the second air zone pressure is about 0.007 psi.

3. The mattress assembly of claim 1, wherein the control module includes a plurality of sensors for measuring pressures within the first and second air zones, the control module also including a plurality of valves configured to adjust air flow into the first and second air zones from an air supply based on the measured pressures to maintain the first and second air zones at the substantially constant first and second pressures, respectively.

4. The mattress assembly of claim 1, wherein the first air zone includes first and second air chambers.

5. The mattress assembly of claim 1, further comprising a bladder located above the body support portion, the bladder being coupled to the control module for selectively inflating and deflating the bladder, the bladder having a first mode of operation in which the bladder is deflated and a second mode of operation in which the bladder is inflated.

6. The mattress assembly of claim 5, wherein the control module is configured to inflate the bladder to a third pressure which is greater than the first and second pressures.

7. The mattress assembly of claim 6, wherein the third pressure is about 0.9 psi.

8. The mattress assembly of claim 5, further comprising a foam layer located above the bladder.

9. The mattress assembly of claim 1, further comprising a foam base located below the body support portion, the foam base including a plurality of side bolsters extending upwardly away from the foam base, the body support portion being located between the plurality of side bolsters.

10. The mattress assembly of claim 9, wherein the base includes a recessed portion and a mounting plate located within the recessed portion, the control module being coupled to the mounting plate.

11. The mattress assembly of claim 10, wherein the foam base and the mounting plate cooperate to define an opening configured to receive at least one air supply line extending through the base.

12. The mattress assembly of claim 1, further comprising at least one strap coupled to the side wall of the coverlet, the at least one strap extending under the body support portion and between opposite side portions of the side wall of the top coverlet.

13. The mattress assembly of claim 5, wherein the second mode of operation configures the bladder to assist in the transfer of patients on and off of the mattress assembly.

14. The mattress assembly of claim 13, wherein the bladder is inflated to approximately 25 inches of water in the second mode of operation.

15. The mattress assembly of claim 5, wherein the second mode of operation configures the bladder to provide support for performing CPR on a patient.

16. The mattress assembly of claim 15, wherein the bladder is inflated to approximately 25 inches of water in the second mode of operation.

17. A mattress assembly for supporting a patient, the mattress assembly comprising a mattress core having a top surface, a bottom surface, and an outer peripheral edge extending between the top surface and the bottom surface, and a coverlet formed from a liquid impermeable material, the coverlet including an upper surface located above the top surface of the mattress core and a side wall extending downwardly from the upper surface, the side wall being configured to extend over the outer peripheral edge of the mattress core and under the bottom surface of the mattress core, the coverlet including an elastic cord coupled to the side wall to hold the side wall of the coverlet under the bottom surface of the mattress core and at least one strap extending under the bottom surface of the mattress core and being coupled between opposite side portions of the side wall of the coverlet.

18. The mattress assembly of claim 17, further comprising a bottom cover portion located below the mattress core.

19. The mattress assembly of claim 17, wherein the mattress core includes a body support portion having a head end, a foot end, and a knee support portion located between the head end and the foot end under the patient's knees, the body support portion having a first air zone extending from the head end to the knee support portion and a second air zone extending from the knee support portion to the foot end, and further comprising a control module coupled to the first and second air zones, the control module being configured to supply air to the first and second air zones to maintain the first air zone at a substantially constant first pressure and to maintain the second air zone at a substantially constant second pressure, the second pressure being less than the first pressure to provide reduced pressure on a patient's calves and feet located on the second air zone.

20. A mattress assembly for supporting a patient, the mattress assembly comprising:

a bottom cover;

a foam base located above the bottom cover, the foam base including a plurality of side bolsters extending upwardly away from the foam base;

a body support portion having at least one air bladder, the body support portion being located on the base between the plurality of side bolsters;

an air control module coupled to the at least one air bladder;

an upper bladder located above the body support portion, the upper bladder being coupled to the air control module for selectively inflating and deflating the upper bladder, the upper bladder having a first mode of operation in which the upper bladder is deflated and a second mode of operation in which the upper bladder is inflated;

a foam layer located above the upper bladder; and a top coverlet located above the foam layer, the top coverlet being formed from a liquid impermeable material.

21. The mattress assembly of claim 20, wherein the body support portion has a head end, a foot end, and a knee support portion located between the head end and the foot end under the patient's knees, the body support portion having a first air zone extending from the head end to the knee support portion and a second air zone extending from the knee support portion to the foot end, and the control module is coupled to the first and second air zones, the control module being configured to supply air to the first and second air zones to maintain the first air zone at a substantially constant first pressure and to maintain the second air zone at a substantially constant second pressure, the second pressure being less than the first pressure to provide reduced pressure on a patient's calves and feet located on the second air zone.

22. The mattress assembly of claim 21, wherein the top coverlet includes an upper surface and a side wall extending downwardly from the upper surface, the side wall being configured to extend under a bottom surface of the bottom cover, the top coverlet including an elastic cord coupled to the side wall to hold the side wall under the bottom surface of the bottom cover and at least one strap extending under the bottom surface of the bottom cover and being coupled between opposite side portions of the side wall of the top coverlet.

23. The mattress assembly of claim 20, wherein the second mode of operation configures the upper bladder to assist in the transfer of patients on and off of the mattress assembly.

24. The mattress assembly of claim 23, wherein the upper bladder is inflated to approximately 25 inches of water in the second mode of operation.

25. The mattress assembly of claim 20, wherein the second mode of operation configures the upper bladder to provide support for performing CPR on a patient.

26. The mattress assembly of claim 25, wherein the upper bladder is inflated to approximately 25 inches of water in the second mode of operation.

* * * * *